US008730109B2

(12) United States Patent
Despesse

(10) Patent No.: US 8,730,109 B2
(45) Date of Patent: May 20, 2014

(54) RADIO FREQUENCY TRANSMITTING/RECEIVING ANTENNA WITH MODIFIABLE TRANSMITTING-RECEIVING PARAMETERS

(75) Inventor: Ghislain Despesse, Saint Egreve (FR)

(73) Assignee: Commissariat a l'Energie Atomique, Paris (FR)

( * ) Notice: Subject to any disclaimer, the term of this patent is extended or adjusted under 35 U.S.C. 154(b) by 604 days.

(21) Appl. No.: 12/564,873

(22) Filed: Sep. 22, 2009

(65) Prior Publication Data

US 2010/0095762 A1 Apr. 22, 2010

(30) Foreign Application Priority Data

Sep. 26, 2008 (FR) ..... 08 56497

(51) Int. Cl.

| | |
|---|---|
| ***H01Q 1/24*** | (2006.01) |
| ***H01Q 1/40*** | (2006.01) |
| ***H01Q 15/16*** | (2006.01) |
| ***H01Q 11/12*** | (2006.01) |

(52) U.S. Cl.

USPC ..... 343/702; 343/723; 343/767; 343/840; 343/873

(58) Field of Classification Search

USPC ..... 343/700 MS, 702, 795, 840, 793, 872, 343/723, 767, 846, 873

See application file for complete search history.

(56) References Cited

U.S. PATENT DOCUMENTS

| | | | | |
|---|---|---|---|---|
| 1,420,254 | A | 6/1922 | Hammond, Jr. | |
| 4,498,086 | A * | 2/1985 | Sandler | 343/807 |
| 6,967,628 | B2 * | 11/2005 | Rawnick et al. | 343/793 |
| 6,992,628 | B2 * | 1/2006 | Rawnick et al. | 343/700 MS |
| 7,260,424 | B2 | 8/2007 | Schmidt | |
| 2009/0322646 | A1 | 12/2009 | Dreina et al. | |

FOREIGN PATENT DOCUMENTS

| | | | |
|---|---|---|---|
| EP | 2139066 | A1 | 12/2009 |
| FR | 2841063 | A | 12/2003 |
| GB | 2435548 | A | 8/2007 |
| GB | 2435549 | A | 8/2007 |
| GB | 2435720 | A | 9/2007 |
| GB | 2436167 | A | 9/2007 |
| JP | 2000357912 | A | 12/2000 |
| WO | 2009/068774 | A2 | 6/2009 |

OTHER PUBLICATIONS

Pollack, M.G. et al., "Electrowetting-Based Actuation of Droplets for Integrated Microfluidics," Lab Chip, 2002, 2, pp. 96-101.

French Search Report in French Application No. FR 0856497, dated Jun. 23, 2009.

* cited by examiner

*Primary Examiner* — Michael C Wimer

(74) *Attorney, Agent, or Firm* — Nixon Peabody LLP

(57) ABSTRACT

Radio transmitting and receiving slot antenna, comprising a transmitting and receiving portion, means for connection to a transmitting and/or receiving circuit, said transmitting and receiving portion being formed of two volumes of liquid delimiting a slot, and means to modify the shape of said volumes of liquid and to modify the width of the slot, said means to modify the shape of said volume of liquid using electrostatic forces, the liquid being electrically conductive, and a control unit controlling the means to deform the volumes of fluid.

20 Claims, 6 Drawing Sheets

FIG.7
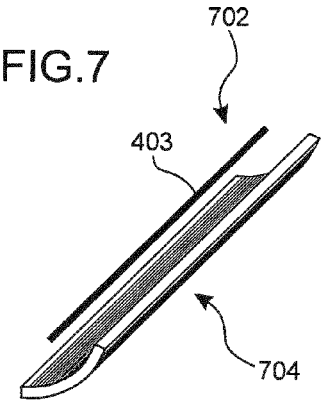
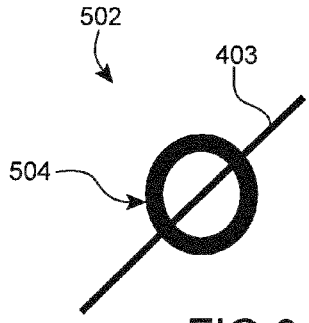
FIG.8
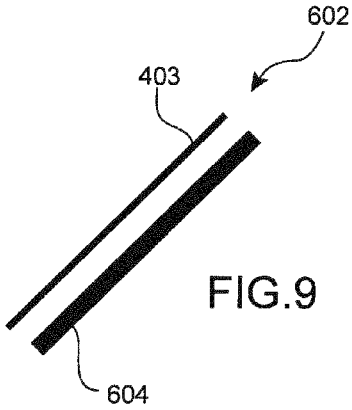
FIG.9
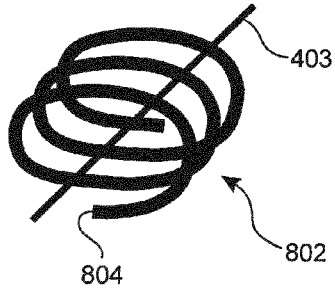
FIG.10
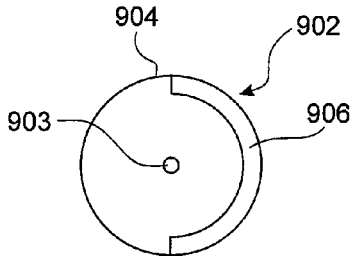
FIG.11

RADIO FREQUENCY TRANSMITTING/RECEIVING ANTENNA WITH MODIFIABLE TRANSMITTING-RECEIVING PARAMETERS

CROSS REFERENCE TO RELATED APPLICATIONS OR PRIORITY CLAIM

This application claims priority of French Patent Application No. 08 56497, filed Sep. 26, 2008.

DESCRIPTION

Technical Area and Prior Art

The present invention relates to a radio frequency antenna whose transmitting-receiving parameters are modifiable.

Numerous antennae used in radio communication systems are of fixed geometry i.e. their length and their configuration are determined at the time of manufacture and cannot be subsequently modified, or only by means of complex operations. Therefore, the operating frequency band of these antennae cannot be modified, and more generally their transmitting-receiving parameters cannot be modified.

To overcome this drawback and to make the operation of systems equipped with this type of antenna independent of the orientation thereof, the antenna is generally sized so that the radiation of the antenna is as isotropic as possible i.e. the transmitted energy is substantially the same in all directions. This is the case with wireless systems. With respect to a mobile phone for example, the orientation of the antenna is practically permanently modified. By means of said antennae, the systems allow communication in any direction. However, this multidirectional transmission has the disadvantage of being energy-consuming. Yet it is being sought to reduce energy consumption in mobile telecommunication systems.

With respect to systems requiring regular changing of frequency band, it can be considered to use several antennae adapted to each of these frequency bands, and to change over regularly from one antenna to another. However, this solution takes up non-negligible space and requires control means to change over from one antenna to another.

Document U.S. Pat. No. 7,260,424 describes an antenna in several pieces which can be joined together using electrically controlled mechanical switches. It is then possible, by switching the switches, to modify the impedance of the antenna and to adapt it to different communication frequencies; however, aside from the complexity of fabricating the antenna and controls, the impedance of the antenna can only be caused to vary in stages. The problem of required space also arises, which means that this type of antenna is little adapted to implantation in systems of mobile telephone type.

Additionally, the switches, even in open status, have capacitive impedance which excludes considering the full disconnection of the antenna element (or parasitic element) it is desired to disconnect. Finally, even if it is managed to insulate each of the pieces of this antenna, there may exist radiofrequency coupling between each of these pieces, which deteriorates overall functioning.

Antennae also exist which are made from an electrically conductive liquid, the resonant frequency of the antenna being adapted by modifying the length of the liquid antenna. This type of antenna is described in document GB 2 435 720. For this purpose, the liquid is contained in a tube of given geometry e.g. spiral shaped, the length of the antenna being modified for example by a temperature control device, by a pump or piston.

Firstly, the shape of the antenna is imposed by the shape of the tube, and cannot therefore be modified when using the antenna. Also, modification of the length of the antenna requires cumbersome means whose response time is relatively long.

It is therefore one of the purposes of the present invention to produce a radio frequency antenna whose transmitting-receiving parameters can be rapidly modified and which is of reduced size.

DESCRIPTION OF THE INVENTION

The above-stated objective is achieved by a radio frequency antenna comprising at least one part made in a conductive liquid, whose shape is modified by electrostatic or electromagnetic forces.

In other words, volumes of liquid are moved by electrowetting or by generating a magnetic field to form an antenna, from the volumes of liquid, whose shape and/or length is adapted to a given frequency band and/or to a given orientation.

This antenna is relatively simple to fabricate and allows a large number of shapes to be produced. Also, the movement of the drops of liquid is very rapid. The frequency band of the antenna according to the invention can therefore be adapted very rapidly, in relation to the orientation of the radio frequency system.

The subject-matter of the present invention is therefore a transmitting and receiving radio antenna, comprising a transmitting and receiving portion, connection means to a transmitting and/or receiving circuit, said transmitting and receiving portion being formed at least in part by at least one volume of liquid, and means to modify the shape of said volume of liquid, said means to modify the shape of said volume of liquid using electrostatic forces, in which case the liquid is electrically conductive, or electrostatic forces, in which case the liquid offers ferromagnetic properties, and a control unit to control the means deforming the volume of fluid.

In one embodiment, the most part of the transmitting and receiving portion of the antenna is in solid form, the volume of liquid forming an extension of the solid transmitting and receiving part and being of adjustable shape.

In one example of embodiment, the solid part may be a wire intended to be connected to a transmitting and/or receiving circuit, and the volume of liquid is provided at one free end of the wire, the means to modify the shape of the volume of liquid being formed by at least one electrode, the volume of liquid being deposited on an electrically insulating surface, offering low wettability with respect to the liquid, the electrode being arranged opposite the volume of liquid relative to the insulating surface.

In another example of embodiment, the solid part may be formed of two electrically conductive plates delimiting a slot between them to form a slot antenna, each plate being covered by a volume of liquid delimiting a slot substantially superimposed over the slot delimited by the plates, the plates forming electrodes electrically insulated from the volumes of liquid, it being possible to set up a difference in potential between the two plates to cause modification of the width of the slot, by drawing close or distancing the volumes of liquid. It is also possible to provide for a polarizing electrode arranged in the slot between the two plates, it being possible to set up a difference in potential between the polarisation electrode and the two plates to cause modification of the width of the slot by drawing the volumes of liquid near or away from the polarisation electrode. Advantageously, the antenna comprises a wall arranged at the slot to avoid contacting between the two volumes of liquid.

In another embodiment, most of the transmitting and receiving portion is in liquid form, the means to modify the shape of the volume or volumes of liquid comprising a plurality of electrodes or electromagnetic coils, distributed underneath an electrically insulating surface on which the volume or volumes of liquid can move, said surface having low wettability with respect to the liquid.

The control unit is able to send individual orders to each of the electrodes or coils.

The radio antenna of the invention may comprise a volume of liquid intended to be connected to the transmitting and/or receiving circuit, and a ground plane connected to the transmitting/receiving circuit. The radio antenna can then form a GSM antenna.

The antenna of the invention may comprise two volumes of liquid separated by a slot which width is substantially constant over its entire length and forming a slot antenna, or separated by a slot which width increases along the slot and forming a broad band antenna.

The control unit can then advantageously generate orders to the electrodes or coils so as to cause rotation of said slot in order to detect the highest energy orientation by scanning.

In another example of embodiment, the antenna comprises a ground plane and a substantially planar electrode held away from this ground plane substantially parallel thereto, said electrode being covered by a liquid film, said electrode offering very good wettability with respect to the liquid, the adjustment of the potential between the ground plane and the electrode enabling modification of the distribution of the liquid film on the surface of the electrode lying opposite the ground plane.

In another example of embodiment, the antenna may comprise a wire or point part and a liquid part distant from the wire part, the liquid part covering a surface provided with means able to modify the shape of the liquid part. For example, the surface is spherical, so as to form a parabolic antenna.

The radio antenna advantageously comprises a sealed casing enclosing the transmitting and receiving part, said transmitting and receiving part being embedded in an electrically insulating liquid non-miscible with the liquid forming at least part of the antenna.

For example, if electrostatic forces are used, the liquid may be mercury, "Indalloy® 46L Ga—In—Sn—Zn Alloy" or water containing one or more additives such as an acid, a silver powder, a carbon powder, or if electromagnetic forces are used, the liquid may be a magneto-rheological liquid.

Another subject-matter of the present invention is a mobile communication apparatus, of mobile telephone type, comprising a transmitting and receiving circuit and at least one antenna according to the present invention connected to said circuit.

A further subject-matter of the invention is the utilization of means to modify the shape of at least one liquid volume of hydraulic fluid by electrostatic forces or by electromagnetic forces to modify the transmitting and receiving parameters of a radio antenna.

BRIEF DESCRIPTION OF THE DRAWINGS

The present invention will be better understood with the help of the following description and appended drawings in which:

FIGS. 6 to 11 are perspective views of other examples of embodiment of antennae according to the present invention.

DETAILED DESCRIPTION OF PARTICULAR EMBODIMENTS

The following description will chiefly describe devices using actuation by electrowetting. We will therefore firstly give a general description of the moving drops of liquid using the principle of electrowetting. However, devices using actuation means which apply electromagnetic forces also come within the scope of the present invention as will be seen below.

Movement of a drop of liquid on a dielectric by electrowetting is described for example in the article by M. G. Pollack, A. D. Shendorov, R. B. Fair: "Electro-wetting-based actuation of droplets for integrated microfluidics", Lab Chip 2 (1) (2002) 96-101.

The forces used to cause movement are electrostatic forces.

Document FR 2 841 063 describes a device using a catenary facing the actuated electrodes to cause movement.

The principle of this type of movement is described below.

A droplet rests on a succession of electrodes from which it is insulated by a dielectric layer and a hydrophobic layer.

When an electrode located in the vicinity of the droplet is actuated, the dielectric layer and the hydrophobic layer, between this actuated electrode and the droplet polarised by an electrode, act as a capacitor. The effects of electrostatic charge induce movement of the droplet on this electrode. The electrode may be a catenary, in which case it maintains electric contact with the droplet as it moves, as described in document FR 2 841 063.

The droplet can therefore be moved little by little, or may spread over the hydrophobic surface to a greater or lesser extent, by successive actuation of the electrodes of the array of electrodes.

Figure 1A:
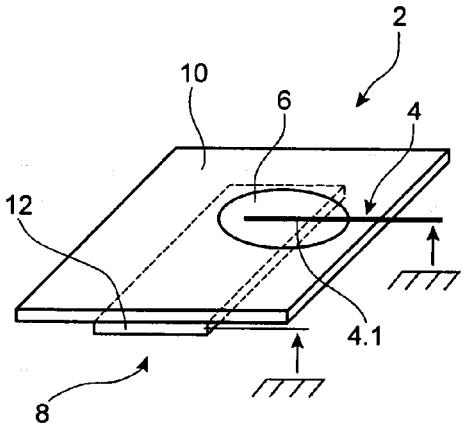
FIGS. 1A and 1B are perspective views of an example of embodiment of an antenna of variable length according to the present invention.
Figure 1B:
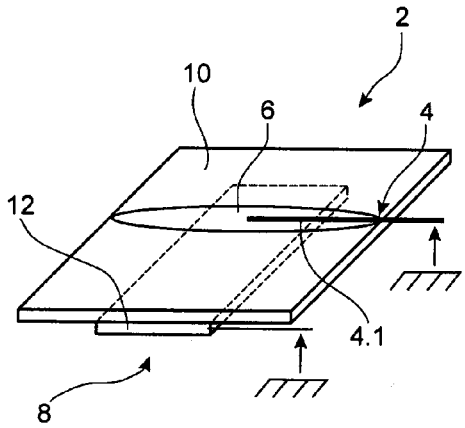

FIGS. 1A and 1B illustrate an example of embodiment of an antenna 2 according to the present invention. In this example, it is a wire antenna.

The antenna 2 is formed of an electrically conductive wire 4 and of a droplet 6 of conductive liquid covering a free end 4.1 of the wire 4. The wire 4 and the droplet 6 form a conductive element whose length determines the operating frequency band of the antenna.

The antenna also comprises means 8 to vary the length of the conductive element, by modifying the shape of the droplet 6.

These means 8 are formed by a plane 10 on which the end 4.1 of the wire 4 and the droplet 6 lie and by an electrode 12 arranged opposite the wire 4 relative to the plane 6. The wire 4 also forms a catenary.

The plane 10 comprises a dielectric layer to electrically insulate the droplet 6 and the electrode 12, and a layer that is non-wettable with respect to the envisaged liquid on the dielectric layer, i.e. hydrophobic for an aqueous solution or oleophobic with respect to a fat. The dielectric layer and the hydrophobic layer may merge.

The liquid of the droplet is chosen so that it is capable of transporting the electric signal to be transmitted. Water may be used for example. Advantageously, liquids are chosen which form a good electrical conductor such as mercury, "Indalloy® 46L Ga—In—Sn—Zn Alloy" or water with one or more additives such as an acid, a silver powder, carbon powder . . . . The quality factor of the antenna is effectively greater the more the liquid is a good conductor. The greatest possible conductivity is sought e.g. at least equal to $10^5$ $S \cdot m^{-1}$.

Silver offers the highest conductivity at ambient temperature, having electrical conductivity of $62.5 \cdot 10^6$ $S \cdot m^{-1}$. The electrical conductivity of copper is $58.8 \cdot 10^6$ $S \cdot m^{-1}$, and the electrical conductivity of mercury is $1.04 \cdot 10^6$ $S \cdot m^{-1}$.

Means (not shown) are provided to polarise the electrode 12. The wire 4 has a fixed potential, the droplet 6 has the same potential.

When the electrode 12 is not polarised, the droplet 6 has a tendency to be spherical through its own properties and the hydrophobic properties of the plane 10. It surrounds the end 4.1 of the wire 4 forming a slight projection. Therefore, the length of the conductive element is substantially equal to that of the wire.

When the electrode 12 is polarised so that it is brought to a significant potential relative to the effective value of the data signal transiting on the antenna, a continuous electric field is set up between the wire 4 and the electrode 12. Electrostatic forces occur, the liquid of the droplet is then attracted by the electrode 12, the droplet deforms and tends to assume the shape of the electrode 12. The effect thereof is to increase the length of the conductive element.

By causing the value of the polarisation potential of the electrode 12 to vary, it then becomes possible to cause the length of the conductive element of the antenna to vary between the length of the wire 4 and the length of the wire increased by the length of the deformed droplet. It is therefore possible to adapt the antenna in relation to the wavelengths it is desired to have transmitted or received. The higher the difference in potential between the wire and the electrode, the more the droplet has a tendency to deform to cover the electrode and hence to lengthen the conductive element.

The greater the length of the antenna, the weaker the resonant frequency of the antenna, and the lower the carrier frequency used to transmit the signal.

In the illustrated example, only one electrode is used to modify the length of the antenna, but evidently the use of several electrodes forming a pathway comes within the scope of the present invention.

Additionally, the illustration of the antenna in FIG. 1 is a schematic illustration. Evidently, in practice, provision could be made to contain the droplet in a tube into which the wire 4 is inserted, the electrode 12 being attached to the tube which would provide an antenna which could easily be applied to a mobile item of equipment for example.

Numerical examples will now be given of the wavelengths which can be obtained by means of the invention.

Conventionally, the length of the antenna is equal to ½ or ¼ of the wavelength or a multiple of the carrier wavelength.

The relationship between wavelength λ and frequency f is:

$$\lambda = 3 \cdot 10^8 / f \qquad \text{(I)}$$

Let us consider that it is desired to fabricate an antenna for a transmission system with four channels, namely frequency channels 2.411 GHz, 2.431 GHz, 2.451 GHz and 2.471 GHz for example used for wireless home video transmission. When one of the channels is used by another user, the system must be able to change over from one channel to another.

Also, it is considered that it is desired to produce a λ/2 antenna i.e. its length is equal to one half of its wavelength.

On the basis of equation (I), λ1 and λ2 can be calculated for the two extreme values of the wavelengths of the channels, i.e. 2.411 GHz and 2.471 GHz respectively:

λ2=0.1244 m and λ2=0.1214 m.

From this, the maximum length L1 and the minimum length L2 can be deduced:

L1=62.2 mm and L2=60.7 mm.

A maximum variation of 2.2 mm beyond 60 mm of antenna is therefore required to reach the four channels. It can therefore be contemplated to produce a wire 4 of 60 mm at whose end a droplet of conductive liquid 6 is placed. Without any electrostatic action, the droplet 6 is compact and only projects by 0.7 mm from the end of the antenna wire (shape of a droplet with a radius of 0.7 mm, i.e. 2.05 μL), the antenna then has a length of 60.7 mm which corresponds to channel 2.471 GHz. Application of polarisation to the electrode 12 causes electrostatic attraction of the droplet 6 which may reach a length of 2.2 mm beyond the end of the antenna wire 4 (shape of a liquid rod with cross-section of around 0.9 mm and length 2.2 mm). The length of the antenna is then 62.2 mm, which corresponds to channel 2.411 GHz.

Figure 2:
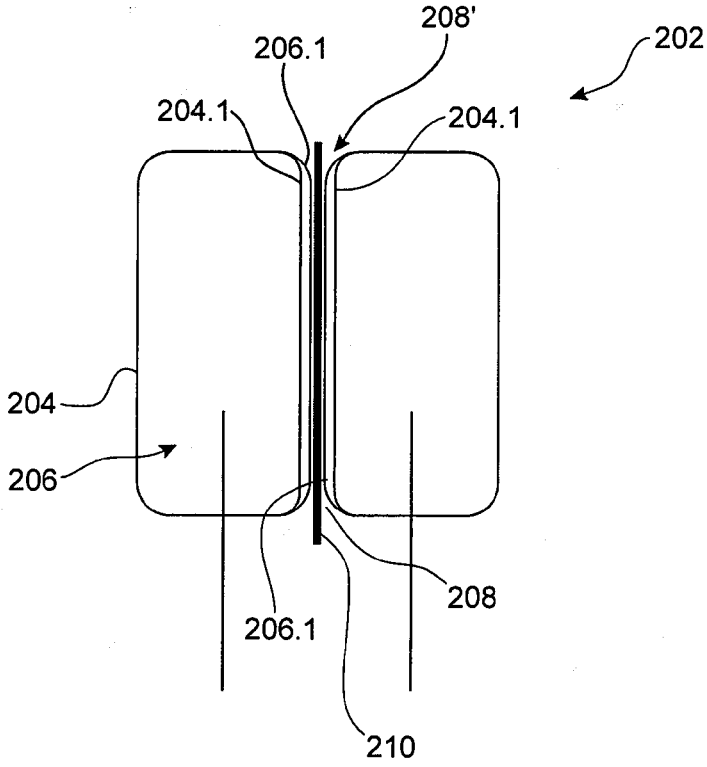
FIG. 2 is a top view of another example of embodiment of an antenna according to the present invention.

FIG. 2 shows another example of embodiment of an antenna according to the invention. It is a slot antenna. In this case the volumes of liquid are used to adjust the length of the slot, the main part of the antenna being made in a highly conductive solid material e.g. copper or gold.

More particularly, the antenna 202 in FIG. 2 comprises two plates 204 in highly conductive material, e.g. copper or gold, arranged one beside the other and defining a slot 208 via their facing edges 204.1. The better the conductivity of the material of the plates 204, the higher the quality factor of the antenna, and hence its efficacy.

In the illustrated example, the antenna also comprises a polarisation electrode 210 arranged in the slot 208.

Each plate 204 is covered by a volume of conductive liquid 206.

Each plate 104 is connected to a transmitting/receiving circuit.

Provision may be made to cover the plates with a film having good wettability with respect to the liquid, to ensure spreading of the liquid on the plates 204. However, capillary forces may be sufficient.

Figure 3A:
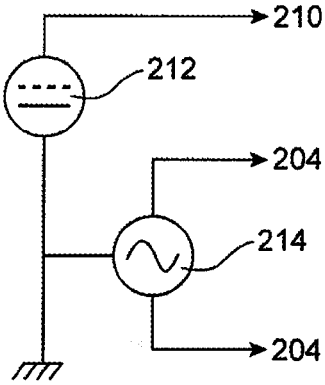
FIGS. 3A and 3B are diagrammatic representation of the polarisation of the electrodes in the example shown in FIG. 2, FIGS. 4A and 4B are top views of an example of embodiment of an antenna of variable shape, FIGS. 4A and 4B illustrating a slot antenna configuration and broadband antenna respectively, FIG. 4A' is a top view of the antenna in FIG. 4A in which the slot has a modified orientation.

We will now explain the functioning of this antenna with reference to the diagram of the electric circuit in FIG. 3A.

The width of the slot 208 can be used to adjust the transmitting/receiving characteristics of the antenna.

The two volumes of liquid define a slot 208' via their facing edges 206.1. When at rest, i.e. in the absence of polarisation of electrode 210, the slot 208 and slot 208' are identical. The width of the slot is therefore equal to the distance separating the plates 204.

The plates 204 form electrodes whose potential is imposed by differential source for example, via the signal to be transmitted 214. The potential of the two plates 204 may or may not be different. The volumes of liquid 206 are therefore at the potentials of the plates 204. The potential of electrode 110 (schematized by the continuous component 212) is imposed. Electrostatic forces are then set up which tend to attract the liquid towards electrode 210. The edges of the volumes of liquid 206 are then attracted towards the electrode 210, projecting beyond the plates, the resulting effect being a reduction in the width of the slot 208'.

The more the electrode 210 is strongly polarised, the more the edges of the volumes of liquid draw together and the narrower the slot.

The width of the slot 208' defined by the volumes 206 therefore varies in relation to the difference in potential between the plates 204 and the polarisation electrode.

Provision may be made for a central wall at the electrode 210 to avoid contacting of the two volumes of liquid 206, this wall defining a minimum slot width.

Alternatively, provision may be made to impose a substantially fixed potential upon the electrode 210, and to cause the potential of the plates 204 to vary.

Figure 3B:
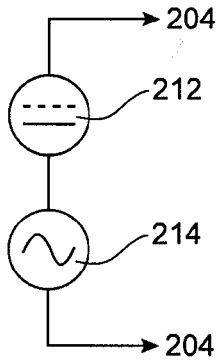

In another variant of embodiment symbolised in FIG. 3B, provision may be made not to use the electrode 210, and to polarise the two plates 204 differently by superimposing a continuous component 212 over the signal to be transmitted 214. If a relatively great potential difference is applied between the plates 204, the liquids placed on each of the solid conductive surfaces will tend to be attracted to each other at the slot 208 and will therefore tend to reduce the width of this slot. As a result, this will increase the operating frequency of the antenna.

Provision could also be made to act solely on a single volume of liquid 206 to modify the width of the slot, in which case there would be dissymmetrical variation in the width of the slot.

Adjustment of the slot allows adjustment of the resonant frequency for example, or of transmission directivity, bandwidth . . . .

Figure 4A:
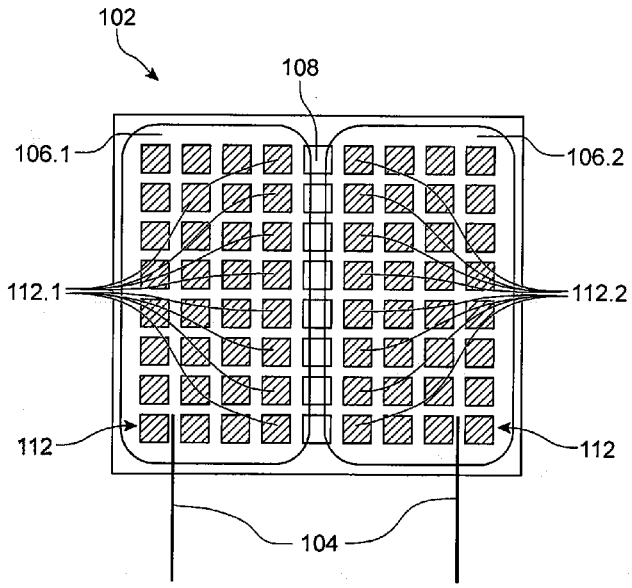
Figure 4B:
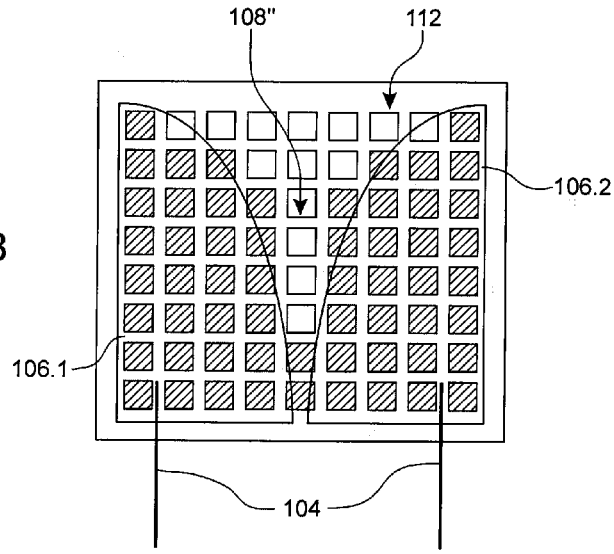
Figure 4A:
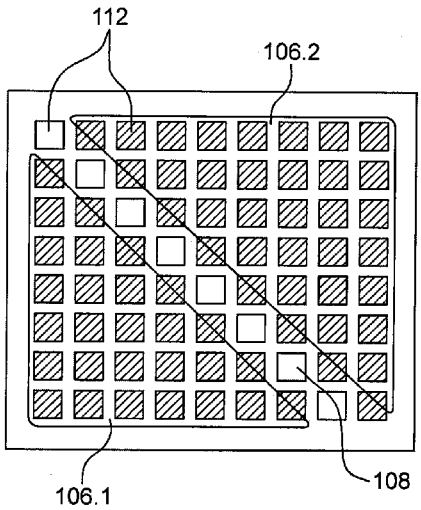

In FIGS. 4A and 4B, other examples of embodiment of a patch antenna according to the invention can be seen, for which a plurality of electrodes are used distributed in a lattice arrangement. In these examples of embodiment, the whole antenna is formed by the volumes of liquid, the liquid not being used solely to adjust a relatively limited portion of the antenna.

FIG. 4A shows a bipolar slot antenna 102 comprising connection means 104 to a data transmitting/receiving circuit, two volumes of conductive liquid 106.1, 106.2 in electric contact with the connection means 104, and means to modify the shape of these volumes of liquid.

The two volumes of liquid 106.1, 106.2 are intended to delimit a slot 108 between of given width and orientation.

A ground plane may be provided above or below the volumes of liquid.

The means to modify the shape of these volumes of liquid comprise a plurality of electrodes 112 distributed over a plane so as to allow modification of the contour of each of the volumes 106.1, 106.2 with sufficient accuracy. In the example illustrated, the electrodes 112 have a lattice distribution, thereby forming a surface divided into a multitude of sources generating electrostatic forces capable of moving volumes 106.1, 106.2 with great accuracy. The electrodes are coated with a dielectric layer and a layer having low wettability with respect to the liquid of volumes 106.1, 106.2, and on which volumes 106.1, 106.2 lie.

Each electrode 112 is individually linked to a control unit which applies a potential to determined electrodes so as to arrange the volumes 106.1, 106.2 to obtain the desired slot width and/or desired band orientation.

The conductive liquid spreads over all the electrodes to which a potential is applied.

In the illustrated configuration, all the shaded electrodes are polarised. If it is desired to modify the width of the slot, all that is required is no longer to polarise the electrodes designated 112.1 and/or the electrodes designated 112.2.

The minimum width of the slot is substantially equal to the width of the electrodes. The smaller the electrodes, the more the variation in width of the slot can be accurate, and the variation in wavelength.

It is also possible to modify the orientation of the slot. It could be considered to delimit an angled slot 108' by polarising the electrodes as illustrated FIG. 4A', the shaded electrodes are polarised.

The size of the slot and its orientation can be modified in real time, during a conversation in the case of a mobile telephone. The slot therefore rotate to orientate transmitting/receiving towards a high power direction. The slot can rotate so as to scan directions in order to find the direction with the highest energy.

It is also possible to cause the wavelengths to vary, and to adapt the impedance of the antenna in real time to the impedance of the transmitting/receiving circuit.

The antenna in FIG. 4A can allow frequency channels to be reached of a few Gigahertzes'.

FIG. 4B shows the antenna of FIG. 1 in which the volumes of liquid are in a configuration such that they form a broadband antenna. The volumes of liquid have concave shapes facing each other and defining a slot 108" substantially in the shape of an upturned triangle. This slot is obtained by simple controlling of the electrodes.

This antenna allows transmission over a wide frequency band, for example it allows very high speed transmission of a few megahertz. The structure evidently allows antennae to be produced other than slot or broadband antennae.

The liquid may be of the same type as the one used in the antenna in FIG. 1.

Figure 5A:
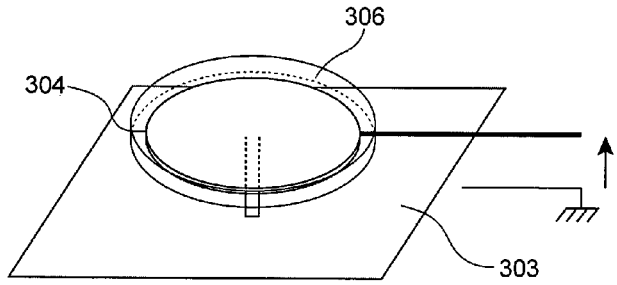
FIG. 5A is a perspective view of a three-dimensional antenna according to the present invention.
Figure 5B:
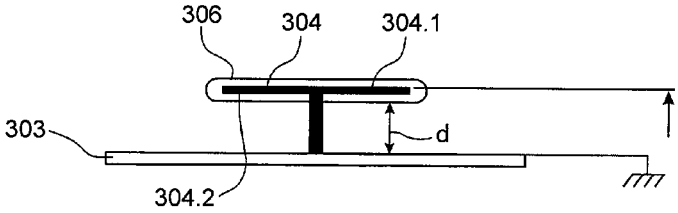
FIG. 5B is a side view of the antenna in FIG. 5A.

FIGS. 5A and 5B illustrate an application of the principle according to the invention, applied to three-dimensional antennae.

The antenna 32 in FIGS. 5A and 5B comprises a ground plane 303 that is connected to the ground and a solid electrode 304 arranged distant from the ground plane 303, for example by means of an electrically insulating support 305. The electrode 304 in the illustrated example is in the shape of a disc, but this shape is not in any way limiting.

The electrode 304 is connected to the transmitting/receiving circuit.

According to the invention, the electrode 304 is coated with a liquid film 306. When at rest, the film is uniformly distributed over the upper surface 304.1 and over lower surface 304.2.

The parameter it is desired to adjust is the distance d between the plate and the ground plane, more particularly the distance between the ground plane 303 and the film coating the lower surface 304.2.

By superimposing a continuous value over the signal to be transmitted (or over the received signal), it is possible to move part of the liquid located on the upper surface 304.1 of the electrode 304 towards the lower surface 304.2 of the electrode 304. The effect of this movement is to reduce the distance d. The characteristics of the antenna are therefore modified.

Advantageously, provision may be made to use an electrode 304 offering very good wettability with respect to the liquid. When electric polarisation is stopped, the liquid then distributes itself spontaneously around the electrode 304 to form a uniform layer all around the electrode 304.

Figure 5C:
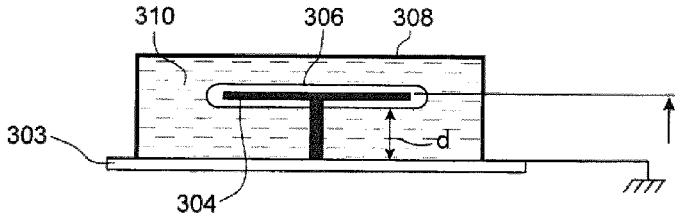
FIG. 5C is an example of embodiment of the antenna in FIG. 5A in which the liquid transmitting portion is enclosed in a sealed casing.

FIG. 5C illustrates a practical embodiment of the antenna in FIGS. 5A and 5B, in which the electrode 304, which is coated with the film 306, and the ground plane 303 are enclosed in a sealed casing 308 to limit the risks of loss or evaporation of the conductive liquid.

In addition, advantageously, provision is made to fill the casing 308 with an insulating liquid 310, of dielectric oil type for example, to complete the global volume of the antenna, which will not mix with the liquid of the film 306.

By embedding the antenna in an insulating liquid, it is possible to reduce risks of evaporation but this also makes the antenna less sensitive to any rough handling which could cause the conductive liquid to move off the support surfaces, despite the electrostatic attraction forces applied by the electrodes. This is of particular interest for an antenna equipping a mobile system.

Evidently the structure of the antenna may be more complex, and provision may be made to add polarisation electrodes to improve control over deformation of the liquid film.

Figure 6:
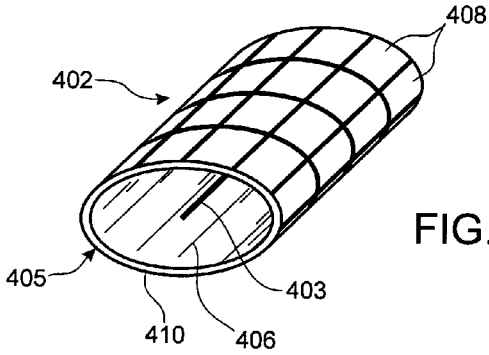

FIG. 6 shows another example of embodiment of a three-dimensional antenna 402.

The antenna 402 comprises a wire part 403 and a cylindrical element 405 surrounding the wire part, whose inner surface is intended to be coated with a film of liquid 406.

For this purpose, the cylindrical element 405 comprises an electrically insulating cylindrical support 410 whose inner surface is coated with the film 406, and electrodes 408 arranged on its outer surface. In the illustrated example, the electrodes 408 form a lattice over the entire outer surface of the cylindrical support 410. Each electrode can be controlled individually or per row or per column.

By modifying the potential between the wire part 403 and the electrodes, it is possible to modify the distribution of the film on the inner surface of the cylindrical support 410, so as only to cover part of this inner surface. The effect of this changed distribution is to modify the direction of transmission and receiving for example.

FIGS. 7, 8, 9 and 10 illustrate examples of the shape which the liquid antenna may assume for different types of controls of the structure in FIG. 6, the cylindrical support 410 not being shown.

An antenna can be seen in FIG. 7 whose control is such that the liquid distributes itself over a cylinder strip 704.

An antenna can be seen in FIG. 8, whose control is such that the liquid is in the shape of a ring 504 centred on the catenary 403.

FIG. 9 shows an antenna 602 whose control is such that the liquid film forms a thread 604 parallel to the wire part 403.

In FIG. 10 an antenna 702 can be seen whose control is such that the liquid forms a spiral 804 surrounding the wire part 403.

In the above-described examples, the distance between the liquid part and the wire part of the antenna can be adjusted by adding a continuous component to the signal to be transmitted or to be received, and the shape of the antenna can be adjusted by electric driving of the electrodes so as to cover the liquid support to a greater or lesser extent.

FIG. 11 shows an example of embodiment of a parabolic antenna according to the present invention.

The antenna 902 therefore comprises a wire or point part 903 and a support 904 of spherical shape coated on its outer surface with electrodes which can be individually controlled. The film 906 covers part of the inner surface of the support 904 to form a cap whose concavity can be oriented by means of the electrodes.

Advantageously, provision may be made that, under the force of gravity, the concavity of the cap is automatically oriented upwardly to ensure satellite communications.

Evidently, the practical example of embodiment shown in FIG. 5C applies to all the described embodiments.

We have described examples of embodiment in which the movement of the volumes of liquid is obtained by electrostatic forces, but it is also possible to consider their movement via electromagnetic forces. For this purpose, liquids are used which offer ferromagnetic properties and which are therefore sensitive to a magnetic field, e.g. magneto-rheological liquids. Means may then be provided to generate magnetic fields e.g. coils instead of electrodes. This structure has the advantage of not carrying any risk of dielectric breakdown. Evidently, the configurations of the examples shown in FIGS. 1 to 11 apply to liquid movement means using electromagnetic forces.

With regard to movement by means of electrostatic forces, the application of a force amounts to placing a certain electric charge on the electrodes. With regard to movement by means of electromagnetic forces, the application of a force amounts to applying a certain electric current in the coils.

Figure 12A:
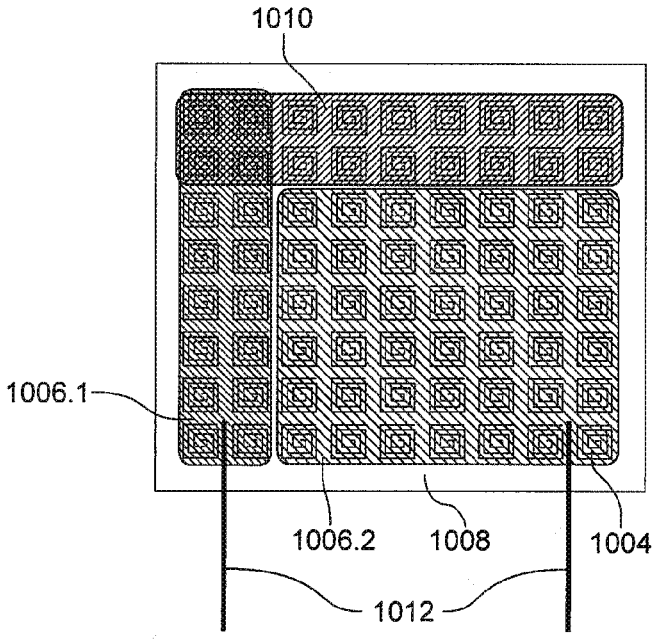
FIGS. 12A and 12B are top views of an example of embodiment of an antenna of variable shape, using electromagnetic forces, FIGS. 12A and 12B respectively illustrating a folded slot antenna configuration and a folded GSM antenna configuration with ground plane.
Figure 12B:
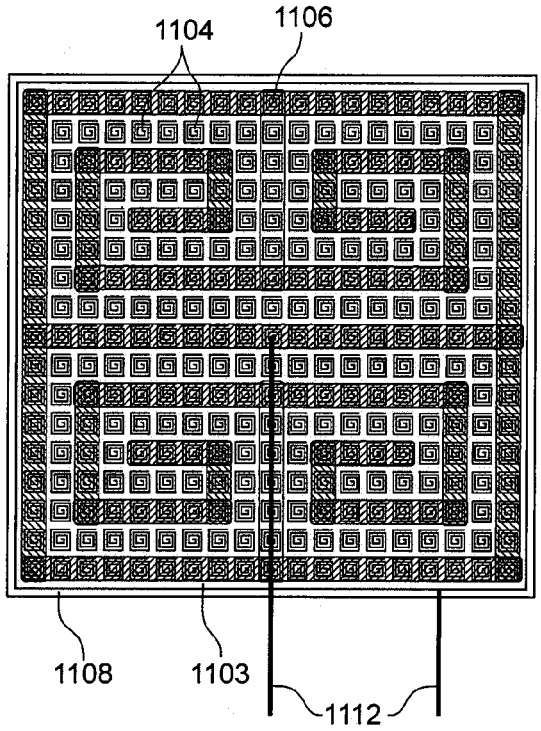

FIGS. 12A and 12B show another embodiment of antennae according to the present invention which use electromagnetic forces to modify the shape of the antenna.

For this purpose, the electrodes are replaced by coils 1004 that are individually supplied, and as liquid 1006, a ferromagnetic liquid is used, e.g. a magneto-rheological liquid.

The coils, when they receive a supply of electric current, generate a magnetic field and attract the magneto-rheological liquid which deforms in relation to the presence or not of a magnetic field.

FIG. 12A shows an antenna which may be obtained by electromagnetic forces.

The coils 1004 are distributed in rows and columns under an insulating surface 1008 and have low wettability with respect to the liquid 1006.

The liquid 1006 is an electrically conductive magneto-rheological liquid.

The antenna also comprises two separate volumes of liquid 1006.1, 1006.2 delimiting a slot 1010 of adjustable shape. Each volume of liquid 1006.1, 1006.2 is connected to the transmitting/receiving circuit via a conductor 1012. The volumes 1006.1 and 1006.2 are shaded for better visibility thereof.

In the illustrated example, it is a folded slot 1010 offering great length in a small space.

The minimum width of the slot is determined by the space between the coils 1004.

By means of a control adapted to each of the coils, it is possible to produce any type of shape as shown in FIG. 12*b* which illustrates a folded GSM antenna with ground plane.

The antenna comprises a plurality of coils 1104 distributed in rows and columns underneath an insulating support 1108, a ground plane 1103 above the support and distanced away from it, and magneto-rheological liquid 1006 deposited on the support.

The ground plane and the liquid 1106 are connected to the transmitting/receiving circuit via connectors 1112.

The liquid 1106 (shaded for reasons of clarity in FIG. 12B) forms spirals in the illustrated example.

The three-dimensional antennae such as illustrated in FIGS. 5A to 11 can evidently be produced using electromagnetic forces to adapt the distribution of the magneto-rheological liquid.

By means of the present invention, it is possible to adjust the parameters of an antenna of conventional type, for example by modifying its length for a wire antenna, or its width for a slot antenna. It is also possible to produce antennae whose shapes can be fully modified by forming most of the transmitting and receiving parts in a conductive liquid which is capable of moving over a surface when so commanded.

Any type of antenna can be produced, such as folded GSM antennae, dipoles . . . .

Therefore, with the invention it is possible to produce antennae easily that can adapt to free frequency bands or to their orientation, thereby providing more efficient transmitting and receiving properties to equipment fitted with these antennae.

In the described examples, the electrodes or coils are of identical size, but evidently it is possible to provide for structures with varying electrode sizes. For example, with respect to slot antennae, provision may be made for the electrodes to be of smaller size and more numerous at the slot, in order to increase the sensitivity of movement of the edges of the volumes of liquid.

The invention claimed is:

1. Radio transmitting/receiving antenna, comprising:

a transmitting and receiving portion, operable as a radiator, including at least one volume of liquid for transmitting or receiving radiation, a connection device electrically coupling the radiator to a transmitting and/or receiving circuit, said connection device being electrically connected to the volume of liquid, a deformation device for modifying the shape of said volume of liquid using electrostatic and/or electromagnetic forces, wherein, in the case of electrostatic forces, the liquid is electrically conductive, and wherein, in the case of electromagnetic forces, the liquid has ferromagnetic properties, and a control unit to control the deformation device to thereby deform the volume of liquid.

2. Radio antenna according to claim 1, wherein the transmitting and receiving portion of the antenna has a liquid portion formed by the volume of liquid and a solid portion, the volume of liquid forming an adjustable extension of the solid portion.

3. Radio antenna according to claim 2, wherein the solid portion is a wire connectable to a transmitting and/or receiving circuit, and the volume of liquid is provided at one free end of the wire, the device configured to modify the shape of the volume of liquid being formed of at least one electrode, the volume of liquid being deposited on an electrically insulating surface having low wettability with respect to the liquid, the electrode being arranged opposite the volume of liquid relative to the insulating surface.

4. Radio antenna according to claim 2, wherein the solid portion is formed of two conductive plates delimiting a slot between them to form a slot antenna, each plate being covered by a volume of liquid delimiting a slot which is substantially superimposed over the slot delimited by the plates, the plates forming electrodes electrically insulated from the volumes of liquid, it being possible to set up a difference in potential between the two plates to cause modification of the width of the slot, by drawing close or distancing the volumes of liquid.

5. Radio antenna according to claim 2, wherein the solid portion is formed of two electrically conductive plates delimiting a slot between them, to form a slot antenna, each plate being covered by a volume of liquid delimiting a slot substantially superimposed over the slot delimited by the plates, the plates forming electrodes electrically insulated from the volumes of liquid, a polarisation electrode being arranged in the slot between the two plates, it being possible to set up a difference in potential between the polarisation electrode and the two plates to cause modification of the width of the slot, by drawing the volumes of liquid close to or away from the polarization electrode.

6. Radio antenna according to claim 4, comprising a wall arranged at the slot to avoid contacting of the two volumes of liquid.

7. Radio antenna according to claim 5, comprising a wall arranged at the slot to avoid contacting of the two volumes of liquid.

8. Radio antenna according to claim 1, wherein the transmitting and receiving portion is in liquid form, the device configured to modify the shape of the at least one volume of liquid comprising a plurality of electrodes or a plurality of electromagnetic coils distributed underneath an electrically insulating surface on which the at least one volume of liquid may be moved, said surface having low wettability with respect to the liquid.

9. Radio antenna according to the claim 8, wherein the control unit sends individual orders to each of the plurality of electrodes or plurality of electromagnetic coils.

10. Radio antenna according to claim 8, comprising a volume of liquid connectable to the transmitting and/or receiving circuit, and a ground plane connectable to the transmitting/receiving circuit.

11. Radio antenna according to the claim 10, forming a GSM antenna.

12. Radio antenna according to claim 8, comprising two volumes of liquid separated by a slot having a width that is substantially constant over its entire length to thereby form a slot antenna, or separated by a slot having a width that increases along the slot to thereby form a broadband antenna.

13. Radio antenna according to claim 12, wherein the control unit generates orders to the electrodes or coils so as to cause rotation of said slot for detection by scanning of the direction with the highest energy.

14. Radio antenna according to claim 1, comprising a ground plane and a substantially planar electrode distanced away from this ground plane substantially parallel thereto, said electrode being covered by a volume of liquid forming a film, said electrode offering very good wettability with respect to the liquid, the adjustment of the potential between the ground plane and the electrode allowing modification of the distribution of the film of liquid over a surface of the electrode facing the ground plane.

15. Radio antenna according to claim 1, comprising a wire or point part and a liquid part spaced away from the wire part, the liquid part covering a surface provided with means able to modify the shape of the liquid part.

16. Radio antenna according to claim 15, wherein the surface is spherical, forming a parabolic antenna.

17. Radio antenna according to claim 1, comprising a sealed casing portion enclosing the transmitting and receiving portion, said transmitting and receiving portion being embedded in an electrically insulating liquid non-miscible with the liquid forming at least part of the antenna.

18. Radio antenna according to claim 17, wherein the liquid is mercury, a Ga—In—Sn—Zn alloy, water containing one or more additives including but not limited to an acid, a silver powder, carbon powder, or a magneto-rheological liquid.

19. Mobile communication apparatus, of mobile telephone type, comprising a transmitting and receiving circuit and at least one radio transmitting/receiving antenna, comprising:

a transmitting and receiving portion, operable as a radiator, including at least one volume of liquid, connection device electrically coupling the radiator to a transmitting and/or receiving circuit, a deformation device for modifying the shape of said volume of liquid using electrostatic and/or electromagnetic forces, wherein, in the case of electrostatic forces, the liquid is electrically conductive, and wherein, in the case of electromagnetic forces, the liquid has ferromagnetic properties, and a control unit to control the deformation device to thereby deform the volume of liquid, said antenna being connected to said circuit.

20. A method for modifying the transmitting and receiving parameters of a radio antenna, the method comprising:

using a volume of hydraulic fluid, having a prescribed shape, as a portion of a conductive element of the radio antenna, said volume comprising an electrically conductive liquid and/or a liquid having ferromagnetic properties that are operated as a radiator of said radio antenna, deforming the shape of the hydraulic fluid to thereby modify the transmitting and receiving parameters of the radio antenna, said deforming being effected by applying an electrostatic force in the case of an electrically conductive liquid, and by applying an electromagnetic force in the case of a liquid having ferromagnetic properties, and delivering signals to or from said radiator to a transmitting and/or receiving circuit through an electrical connection coupling the radiator to the transmitting and/or receiving circuit.

* * * * *